US010643403B2

(12) United States Patent
Madison et al.

(10) Patent No.: US 10,643,403 B2
(45) **Date of Patent: *May 5, 2020**

(54) PREDICTIVE DIAGNOSTIC METHOD AND SYSTEM

(71) Applicant: Innova Electronics Corporation, Irvine, CA (US)

(72) Inventors: Robert Madison, Lakewood, CA (US); Keith Andreasen, Garden Grove, CA (US); Michael Nguyen, Norwalk, CA (US)

(73) Assignee: Innova Electronics Corporation, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/871,594

(22) Filed: Sep. 30, 2015

(65) Prior Publication Data

US 2016/0027223 A1 Jan. 28, 2016

Related U.S. Application Data

(63) Continuation-in-part of application No. 13/589,532, filed on Aug. 20, 2012, now Pat. No. 9,177,428.

(51) Int. Cl.

| | |
|---|---|
| ***G07C 5/00*** | (2006.01) |
| ***G07C 5/08*** | (2006.01) |
| ***G07C 5/12*** | (2006.01) |

(52) U.S. Cl.

CPC ..... *G07C 5/0808* (2013.01); *G07C 5/12* (2013.01)

(58) Field of Classification Search

CPC ..... G07C 5/006; G07C 5/0808; G07C 5/008
USPC ..... 701/29.6
See application file for complete search history.

(56) References Cited

U.S. PATENT DOCUMENTS

| | | | |
|---|---|---|---|
| D334,560 | S | 4/1993 | Wilson |
| 5,347,211 | A | 9/1994 | Jakubowski |
| D377,622 | S | 1/1997 | Chen |
| 5,635,841 | A | 6/1997 | Taylor |
| 5,758,300 | A | 5/1998 | Abe |
| 5,767,681 | A | 6/1998 | Huang |
| 5,809,437 | A | 9/1998 | Breed |
| 5,859,628 | A | 1/1999 | Ross et al. |
| 5,884,202 | A | 3/1999 | Arjomand |
| 6,000,413 | A | 12/1999 | Chen |

(Continued)

FOREIGN PATENT DOCUMENTS

| | | |
|---|---|---|
| WO | WO 0186576 | 11/2001 |

*Primary Examiner* — Khoi H Tran
*Assistant Examiner* — Rodney P King
(74) *Attorney, Agent, or Firm* — Stetina Brunda Garred and Brucker; Mark B. Garred

(57) ABSTRACT

There is provided a method of predicting defects likely to occur in a vehicle over a predetermined period. The method includes receiving vehicle characteristic data regarding a vehicle under consideration, and comparing the received vehicle characteristic data with a defect database. The defect database includes information related to defects that have occurred in different vehicles and the mileage at which such defects occurred. The method additionally includes identifying defects that occurred in vehicles corresponding to the vehicle under consideration, and the mileage at which such defects occurred. Defects which fail to satisfy minimum count requirements are then filtered out, and the defects are then sorted in order of the highest defect count.

38 Claims, 5 Drawing Sheets

(56) References Cited

U.S. PATENT DOCUMENTS 6,055,468 A 4/2000 Kaman et al.
6,094,609 A 7/2000 Arjomand
6,169,943 B1 1/2001 Simon et al.
6,225,898 B1 5/2001 Kamiya et al.
6,263,268 B1 7/2001 Nathanson
6,389,337 B1 5/2002 Kolls
6,438,471 B1 8/2002 Katagishi et al.
6,499,385 B2 12/2002 Protti
6,535,112 B1 3/2003 Rothshink
6,587,768 B2 7/2003 Chene et al.
6,611,740 B2 8/2003 Lowrey et al.
6,650,318 B1 11/2003 Arnon
6,718,425 B1 4/2004 Pajakowski et al.
6,732,031 B1 5/2004 Lightner et al.
6,807,469 B2 10/2004 Funkhouser et al.
6,836,708 B2 12/2004 Tripathi
6,847,916 B1 1/2005 Ying
6,868,369 B2 3/2005 Huang
6,925,368 B2 8/2005 Funkhouser et al.
6,940,270 B2 9/2005 Chen
D510,287 S 10/2005 Chen
6,957,133 B1 10/2005 Hunt et al.
6,968,733 B2 11/2005 Andreasen
7,030,742 B2 4/2006 Treadway
7,085,680 B2 8/2006 Huang
7,116,216 B2 10/2006 Andreasen
7,209,813 B2 4/2007 Namaky
RE39,619 E 5/2007 Andreasen
D545,223 S 6/2007 Chen
D559,137 S 1/2008 Protti
D560,129 S 1/2008 Rich
D560,527 S 1/2008 Rich
7,321,774 B1 * 1/2008 Lau ..... G01S 19/09 340/539.13
7,325,775 B2 2/2008 Chen
D563,249 S 3/2008 Chen
7,363,149 B2 4/2008 Klausner et al.
D569,280 S 5/2008 Chen
7,376,497 B2 5/2008 Chen
D571,241 S 6/2008 Andreasen
7,437,227 B2 10/2008 Andreasen
D581,822 S 12/2008 Madison
7,464,000 B2 12/2008 Huang
D588,621 S 3/2009 Baty
D590,387 S 4/2009 Chen
7,520,668 B2 4/2009 Chen
RE40,798 E 6/2009 Chen
RE40,799 E 6/2009 Chen
7,603,293 B2 10/2009 Chen
7,620,484 B1 11/2009 Chen
D610,586 S 2/2010 Chen
7,734,390 B2 6/2010 Chen
7,778,750 B2 8/2010 Knight et al.
D624,446 S 9/2010 Chen
D624,838 S 10/2010 Chen
D625,209 S 10/2010 Chen
D625,210 S 10/2010 Chen
D625,634 S 10/2010 Chen
7,904,219 B1 3/2011 Lowrey et al.
7,974,750 B2 7/2011 Namaky
8,019,503 B2 9/2011 Andreasen
8,024,083 B2 9/2011 Chen
D646,188 S 10/2011 Chen
D646,599 S 10/2011 Chen
8,032,419 B2 10/2011 Chen
8,068,951 B2 11/2011 Chen et al.
8,301,329 B2 10/2012 Andreasen
8,306,687 B2 11/2012 Chen
8,370,018 B2 2/2013 Andreasen et al.
8,509,986 B1 8/2013 Chen
8,600,610 B2 12/2013 Bertosa et al.
8,630,765 B2 1/2014 Chen
8,811,008 B2 8/2014 Selkirk et al.
8,825,270 B2 9/2014 Chen
8,825,271 B2 9/2014 Chen
8,831,814 B2 9/2014 Chen
8,855,621 B2 10/2014 Chen
8,862,117 B2 10/2014 Chen
8,880,274 B2 11/2014 Chen
8,909,416 B2 12/2014 Chen et al.
9,002,554 B2 4/2015 Chen
9,014,908 B2 4/2015 Chen
9,026,400 B2 5/2015 Chen et al.
9,117,319 B2 8/2015 Chen et al.
9,123,051 B2 9/2015 Chen
9,177,428 B2 11/2015 Nguyen et al.
9,183,681 B2 11/2015 Fish
D745,029 S 12/2015 Gray et al.
D746,316 S 12/2015 Gray et al.
D746,323 S 12/2015 Gray et al.
9,213,332 B2 12/2015 Fish et al.
D747,734 S 1/2016 Gray et al.
D749,623 S 2/2016 Gray et al.
9,262,254 B2 2/2016 Bertosa et al.
9,292,977 B2 3/2016 Bertosa et al.
D757,059 S 5/2016 Gray et al.
9,329,633 B2 5/2016 Selkirk et al.
D770,462 S 11/2016 Gray et al.
9,858,731 B2 1/2018 Fish et al.
9,904,634 B2 2/2018 Case, Jr. et al.
10,295,333 B2 5/2019 Fish et al.
10,467,906 B2 11/2019 Fish et al.
2003/0171111 A1 9/2003 Clark
2004/0110472 A1 6/2004 Witkowski
2008/0004764 A1 * 1/2008 Chinnadurai ..... G05B 23/0235 701/31.4
2008/0154755 A1 * 6/2008 Lamb ..... G06Q 10/063 705/32
2009/0062978 A1 * 3/2009 Picard ..... G06Q 10/06 701/31.4
2014/0046800 A1 2/2014 Chen
2017/0186054 A1 6/2017 Fish et al.
2018/0101775 A1 4/2018 Fish

* cited by examiner

30

| COMPONENTS LIKELY TO FAIL | MILEAGE BRACKETS | | | | | | |
|---|---|---|---|---|---|---|---|
| | 0 - 5K MILES | 5K - 10K MILES | 10K - 15K MILES | 15K - 20K MILES | 20K - 25K MILES | 25K - 30K MILES | ... |
| COMPONENT 1 | 0 | 0 | 3 | 0 | 5 | 7 | ... |
| COMPONENT 2 | 0 | 1 | 1 | 2 | 0 | 5 | ... |
| COMPONENT 3 | 0 | 1 | 0 | 1 | 1 | 0 | ... |
| COMPONENT 4 | 1 | 2 | 1 | 3 | 2 | 4 | ... |
| COMPONENT 5 | 0 | 1 | 0 | 0 | 1 | 0 | ... |
| % TOTAL | COMP. 4 - 100% | COMP. 2 - 20%<br>COMP. 3 - 20%<br>COMP. 4 - 40%<br>COMP. N - 20% | COMP. 1 - 60%<br>COMP. 2 - 20%<br>COMP. 4 - 20% | COMP. 2 - 34%<br>COMP. 3 - 16%<br>COMP. 4 - 50% | COMP. 1 - 25%<br>COMP. 3 - 11%<br>COMP. 4 - 22%<br>COMP. N - 11% | COMP. 1 - 43%<br>COMP. 2 - 31%<br>COMP. 4 - 25% | ... |

FIG. 3

PREDICTIVE DIAGNOSTIC METHOD AND SYSTEM

CROSS-REFERENCE TO RELATED APPLICATIONS

This present application is a continuation-in-part application of U.S. patent application Ser. No. 13/589,532, filed Aug. 20, 2012, the contents of which are incorporated by reference herein.

STATEMENT RE: FEDERALLY SPONSORED RESEARCH/DEVELOPMENT

Not Applicable

BACKGROUND

The present invention relates to automotive diagnostics, and more specifically, to a system and method of predicting automotive problems or failure based on a collection of historical information.

Automotive repair is, for the most part, inevitable. If driven long enough, most automobiles will require at least some form of routine maintenance and repair. Although repairs are almost certain, it is unknown as to when the vehicle will fail, and therefore, automotive failure usually comes as a surprise. Furthermore, the average vehicle owner does not know what those failures are likely to be or what the related cost of repair would entail.

The difficulty in predicting diagnostic events for a vehicle stem from the fact that different vehicles exhibit different vulnerabilities. Therefore, a particular component may be susceptible to failure in a particular vehicle, and not as susceptible to failure in another model of vehicle. Furthermore, that same component may have a different susceptibility of failure from one model year to the next in the same model of vehicle. Thus, there is not a universal template or formula that can be applied to all vehicles for predicting when failure is likely to occur.

To the average automobile owner, there is a considerable amount of uncertainty associated with automotive diagnostics and repair. Automobiles are complex electro-mechanical devices, and as such, when a problem associated with the operation of the automobile arises, it may be well beyond the skill of the ordinary automobile owner to identify the problem and know how to perform the related fix. Thus, automobile owners have been relying on automotive professionals, such as a repair shop or dealership, to assist in the diagnosis and repair of their automobiles.

Although automotive professionals may be helpful in diagnosing and repairing an automotive problem, there is a certain level of distrust consumers have associated with automotive professionals. In some instances, the automotive professionals may leverage their experience and knowledge when dealing with the consumer to drive up the cost or to encourage the consumer to make repairs which may not be absolutely necessary. Therefore, consumers tend to feel as if they have been taken advantage of when they visit automotive professionals. That feeling is compounded by the fact that costs associated with having an automotive professional service your vehicle tends to be very high.

Aside from automotive professionals, oftentimes the best available information is from someone who currently owns or previously owned the same year, make, and model of the vehicle under consideration. That person can describe their experience with the vehicle, including the maintenance history or any repairs that performed on the vehicle, and when those repairs took place (i.e., at 50,000 miles, etc.).

Although the information received from the experienced individual may provide some measure of assistance in gauging the diagnostic future of a particular vehicle, the information provided by the experienced individual may not be representative of a pattern of failure. In this regard, there is a likelihood that the failures, or lack thereof, identified by the experienced individual may not be attributable to a reliable pattern, but instead are simply anecdotal events which may provide very little basis for reliability.

As such, there is a need in the art for a reliable and comprehensive predictive diagnostic system and method which provides a predictive diagnostic summary for a vehicle under consideration, wherein the predictive diagnostic summary is compiled from a historical database of similar vehicles.

BRIEF SUMMARY

According to one embodiment of the present invention, there is provided a method of predicting defects likely to occur in a vehicle over a predetermined period. The method includes receiving vehicle characteristic data regarding a vehicle under consideration, and establishing a defect database including information related to defects that have occurred in different vehicles and the mileage at which such defects occurred. The method additionally includes identifying defects that occurred in vehicles corresponding to the vehicle under consideration, and the mileage at which such defects occurred. Defects which fail to satisfy minimum count requirements are then filtered out, and the defects are then sorted in order of the highest defect count.

The received vehicle characteristic data may include vehicle identification information including the year, make, model, engine, and current mileage of the vehicle under consideration. The defect database information may include the year, make, model, engine, defect(s), and mileage of the referenced vehicle as of the time of each associated defect.

The method may additionally include the step of comparing vehicle characteristic data associated with the vehicle under test with vehicle characteristic data associated with the identified defects stored in the defect database to identify defects that have occurred in vehicles that substantially correspond to the vehicle under consideration.

The method may also include the step of restricting the identified defects to defects that have occurred in substantially corresponding vehicles that are associated with a reference mileage that is within a mileage bracket that substantially corresponds to the current mileage of the vehicle under test. The mileage bracket may extend from a mileage less than the current mileage to a mileage greater than the current mileage. The mileage bracket may extend from a mileage approximately 15,000 less than the current mileage to a mileage approximately 30,000 miles greater than the current mileage.

The method may additionally include the step of adjusting the current mileage to the nearest 5,000 mile gradient. The mileage bracket may extend from 15,000 miles less than the adjusted mileage to 30,000 miles greater than adjusted mileage.

The method may further include the step of receiving live data from the vehicle under consideration. The live data may include diagnostic information regarding operating characteristics of an automotive device associated with at least one defect within the mileage bracket. The method may additionally include the step of adjusting the current mileage based on diagnostic information indicating the operating condition of the automotive device associated with the defect. The step of adjusting the current mileage may include the step of increasing the current mileage where the diagnostic information associated with the automotive device associated with the defect indicates that the associated device is not in optimum operating condition. The step of adjusting the current mileage may also include the step of increasing the current mileage where the diagnostic information indicates that the device associated with the defect is in optimum operating condition.

The method may also include the steps of receiving information regarding the climatic region in which the vehicle under consideration has been used, and adjusting the current mileage based on the information regarding the climate region. The step of adjusting the current mileage based on the information regarding the climatic region may comprise the step of increasing the current mileage where the information regarding the climate region indicates that the vehicle has operated in a region characterized by harsh climate conditions. At least one defect may be associated with a climatically sensitive vehicle device, which may include a muffler, a body panel, a radiator, a battery, a door lock, and a starter.

The method may include the step of limiting the identified defects to those defects which occurred in a mileage bracket that includes the mileage of the vehicle under consideration.

The defects in the defect database may be derived from actual repair records, or from a probabilistic determination of a most likely defect based on vehicle diagnostic data.

The received vehicle characteristic data may include geographic information associated with the vehicle under consideration.

The method may include the step of adjusting the mileage associated with the identified defects based on vehicle characteristic data. The mileage associated with the identified defects may be lowered based on the vehicle characteristic data. The mileage associated with the identified defects may be raised based on the vehicle characteristic data.

According to another embodiment, there is provided a predictive diagnostic system for generating a predictive diagnostic report for a vehicle under consideration. The predictive diagnostic system includes a defect database having information related to defects that have occurred in different reference vehicles and the reference mileage at which such defects occurred, wherein each reference vehicle is associated with classification data. A comparison module is in operative communication with the defect database and is configured to compare vehicle characteristic data associated with the vehicle under consideration and to identify defects that have occurred in certain ones of the different reference vehicles having associated vehicle characteristic data that is substantially similar to the vehicle characteristic data associated with the vehicle under consideration and a reference mileage that is substantially similar to the current mileage of the vehicle under consideration.

The predictive diagnostic system may also include a report generating module in operative communication with the comparison module and configured to generate a predictive diagnostic report including the identified defects and the reference mileage at which such defects occurred.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 3 is one embodiment of a preliminary diagnostic matrix;

Figure 1:
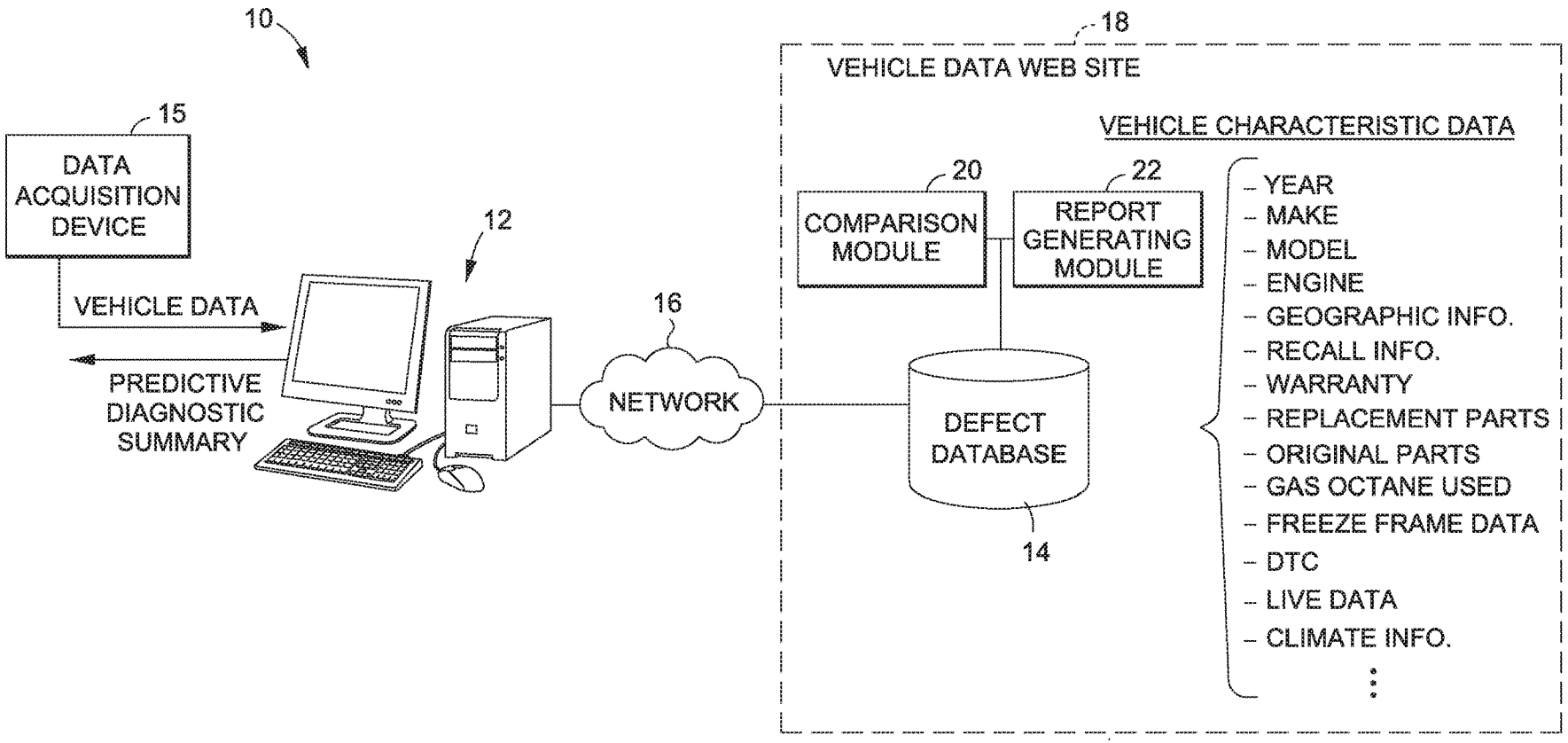
FIG. 1 is a schematic view of one embodiment of a predictive diagnostic system.
Figure 2:
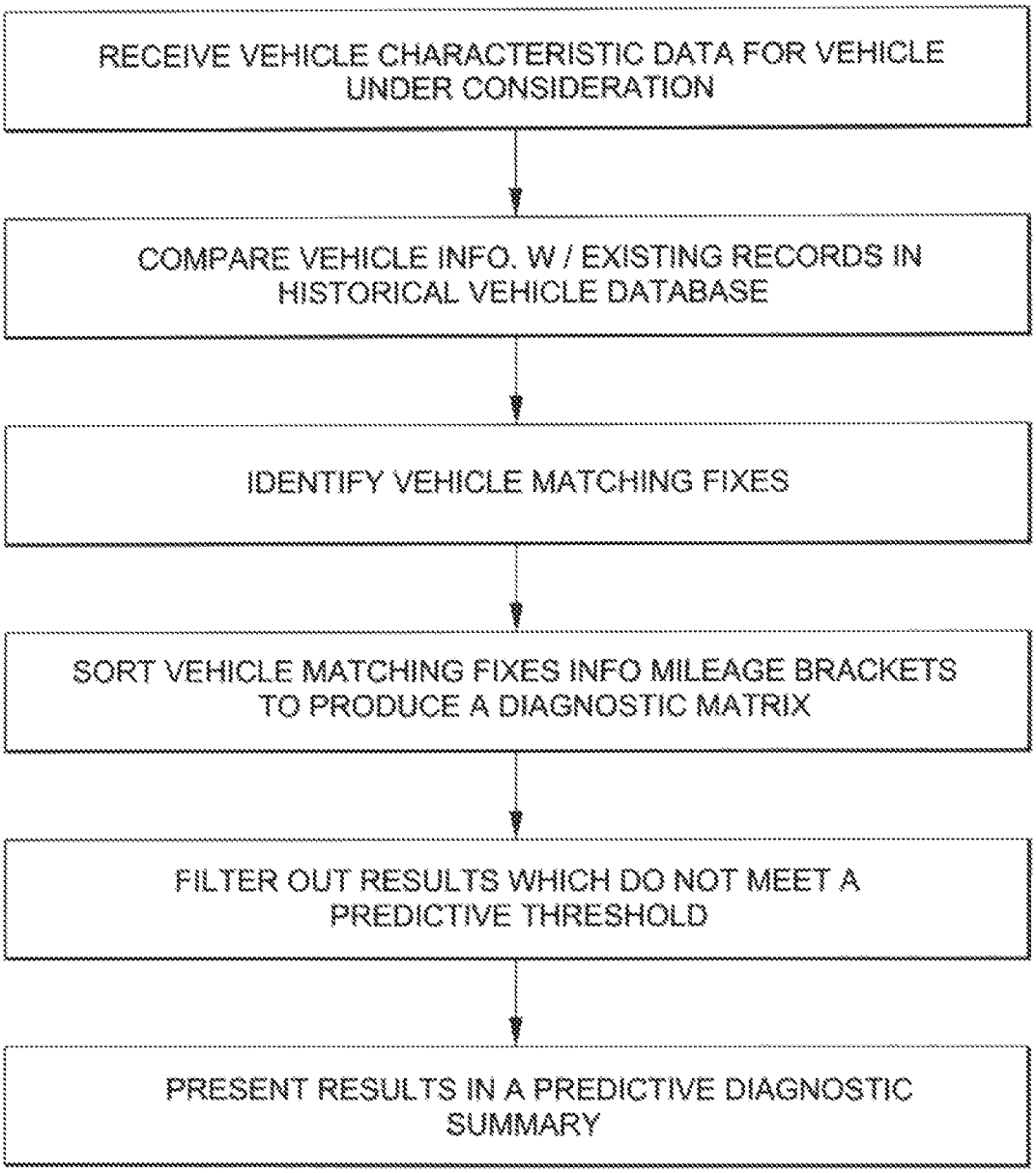
FIG. 2 is a flow chart listing the steps of one embodiment of a predictive diagnostic method.

The present invention is best understood by reference to the following detailed description when read in conjunction with the accompanying drawings.

DETAILED DESCRIPTION

Referring now to the drawings, wherein the showings are for purposes of illustrating a preferred embodiment of the present invention only, and not for purposes of limiting the same, there is shown a predictive diagnostic system 10 capable of determining a likelihood of failure for a particular vehicle system or component. The predictive diagnostic system 10 compares vehicle characteristic data associated with a vehicle under consideration with stored information in a historical defect database to identify defects that have occurred in the same or substantially similar vehicles, and the mileage at which those defects occurred. In this regard, the predictive diagnostic system 10 may predict a low, medium or high probability of failure for a component(s) within a certain mileage range, and thus, provides the owner of the vehicle with a probable likelihood of which components are likely to fail over certain mileage ranges. The predictive diagnosis may allow the owner to preempt the failure by replacing the component beforehand, or if the vehicle begins to operate at a sub-optimal level, the owner will have a good idea of what component may need replacing. Therefore, the owner may be able to resolve the problem on his own, or if the owner takes the vehicle to an automotive professional, the owner will have a good idea of what is needed to fix the problem, rather than relying solely on the recommendation of the automotive professional.

Referring now specifically to FIG. 1, the predictive diagnostic system 10 includes an electronic computing device 12 and a historical defect database 14 in operative communication with each other through a network 16. The computing device 12 is operative to allow the user to upload/input vehicle characteristic data for the vehicle under consideration. The vehicle characteristic data being independent of any live data indicative of the operating condition of vehicle devices. The vehicle characteristic data is preferably communicated to the computing device 12 using a hand held vehicle data acquisition device 15, such as a diagnostic code reader, an integrated diagnostic scan tool, or a dongle which is connectable to a vehicle diagnostic port to communicate vehicle data between the vehicle electronic control unit (ECU) and the computing device 12. The communication between the data acquisition device and the computing device 12 may be via either a wired or wireless connection, or a combination of both. In this regard, the computing device 12 may be a desktop computer, laptop computer, tablet computer, smart phone, personal digital assistant or other computing devices known by those skilled in the art.

As shown in FIG. 1, the historical defect database 14 is hosted on a server, which may be accessible by the computing device 12 via a website 18 which may be a subscription based website or offered as a part of a vehicle service/warranty plan. The user may visit or log on to the website 18 to upload the vehicle characteristic data to the historical defect database 14, as will be described in more detail below. Information is exchanged between the website 18 and the computing device 12 via the network 16, which may include the Internet, a local area network, or other communication systems.

The historical database 14 is a comprehensive compilation of historical vehicle data. As used herein, the stored information in the defect database includes, but is not limited to, information associated with defects which are not commonly known to occur in certain vehicles. Each entry into the database 14 relates to a system or component failure for a specific vehicle associated with characteristic data representative of the vehicle. For instance, the characteristic data may include vehicle identification information, such as the year, make, model, engine of the vehicle and current mileage. Therefore, to determine the predictive diagnosis for the vehicle under consideration, the characteristic data associated the vehicle under consideration is entered into the defect database 14 and the characteristic data is matched with vehicle data in the database associated with similar characteristic data, e.g., stored vehicle identification data, to determine the likelihood of failure within a certain mileage range.

The failures/defects listed in the historical defect database 14 may be identified according to several different strategies. In one embodiment, the defects are associated with actual repairs performed at a repair shop. In another embodiment, the defects are determined by insurance claims submitted to an insurance company. In yet another embodiment, the defects are determined based on a probabilistic determination of a likely defect based on an analysis of vehicle data. For more information related to the probabilistic determination, please see U.S. patent application Ser. No. 13/567,745 for Handheld Scan Tool with Fixed Solution Capability, now U.S. Pat. No. 8,909,416 issued Dec. 9, 2014, the contents of which are incorporated herein by reference. The failures/defects listed in the database 14 may also be determined according to a combination of any of the strategies listed above, or according to other means known by those skilled in the art.

The system 10 further includes a comparison module 20 and a report generating module 22 in operative communication with each other and the defect database/server 14. The comparison module 20 is operative to match the vehicle characteristic data associated with the vehicle under consideration with similar data found in the database 14 to identify defects which have occurred in those matching vehicles. The report generating module 22 is operative to compile the results and generate the predictive diagnostic report, which is presented to the user on a display, such a display associated with computing device 12.

The following example illustrates benefits which the predictive diagnostic system 10 provides. In this example, the vehicle under consideration is a 2005 HONDA™ ACCORD™, although it is understood that the predictive diagnostic system 10 may be used with any vehicle. The defect database 14 includes several entries related to a 2005 HONDA™ ACCORD™. Based on those entries, an owner of a 2005 HONDA ACCORD can determine the likelihood that his vehicle will experiences problems at certain mileage ranges. For example, between 75,000 and 100,000 miles, there may be a high likelihood that the owner may need to replace the ignition coil, a median probability or likelihood that the user will need to replace the camshaft position sensors, and a low probability that the owner will need to replace the engine coil module.

According to one embodiment, the input into the defect database 14 is vehicle characteristic data representative of the vehicle under consideration. Thus, the more vehicle characteristic data entered by the user, the more accurate and precise the resultant predictive diagnosis will be. Along these lines, the vehicle characteristic data may not only include vehicle identification information, such as the year, make, model, and engine, as mentioned above, but may also include other information that is specific to the vehicle under consideration. For instance, the vehicle characteristic data may include the geographic area (state, city, zip code, etc.) or climatic conditions in which the vehicle is primarily driven. Vehicles in different geographic areas may encounter symptoms related to the geographic area in which the vehicle is driven. For instance, vehicles driven in the northern part of the United States regularly encounter snow in the winter months. Road maintenance crews in those areas of the country regularly spread salt on the roads to mitigate slippery road conditions. Thus, as the vehicle drives over the salted roads, the undercarriage of the vehicle may be exposed to the salt, which may cause rust/corrosion or may lead to other problematic conditions.

However, vehicles driven in southern states may not be susceptible to the same problems since those vehicles are generally not driven over salted roads. However, other geographic locations offer different environmental conditions which may be problematic for the vehicle, i.e., desert areas may lead to engine overheating. Therefore, the geographic location in which the vehicle under consideration is driven may lead to a more accurate and precise predictive diagnosis. Exemplary components/devices which may be climatically or geographically sensitive include may include the vehicle's muffler, body panel (susceptible to rust), radiator, battery, door lock, and starter.

Other vehicle characteristic data which may be entered into the historical database is recall information, usage information (i.e., how many miles the vehicle is driven per year), warranty information, replacement parts on the vehicle, original parts on the vehicle, gas octane used, maintenance records. Thus, the vehicle characteristic data entered into the defect database 14 allows the user to obtain matches with vehicle records associated with vehicles that not only are the same or similar to the vehicle under consideration, but were also operated and maintained in a similar fashion.

According to one embodiment, and referring now specifically to FIG. 3, after the vehicle characteristic data is entered into the defect database 14, a preliminary diagnostic matrix 30 will be generated which shows the predicted components/systems that are likely to fail along one axis, and several mileage brackets along another axis. The body of the matrix 30 is filled with the number of failures associated with the respective components/systems occurring in each mileage bracket for the respective components.

The number of failures may then be totaled for each component within each mileage bracket to determine a percentage of failure (see bottom row of matrix 30). For instance, as shown in the example depicted in FIG. 3, there was only 1 failure within the 0-5,000 mile bracket, with that sole failure being attributable to Component 4. Thus, Component 4 comprises 100% of the failures in the 0-5,000 mileage bracket. In the 5,000-10,000 mileage bracket, there were 5 total failures, with one being attributable to Component 2, one being attributable to Component 3, two being attributable to Component 4 and one being attributable to Component 5. Thus, Component 2 comprises 20% of the failures, Component 3 comprises 20% of the failures, Component 4 comprises 40% of the failures and Component 5 comprises 20% of the failures. This totaling process is completed to determine the percentage of failure for the components failing in each mileage bracket.

In one implementation, the predictive diagnostic system 10 may filter out results which do not meet or exceed a defined threshold. In this regard, it is desirable to only report failures which are believed to be representative of a pattern and thus indicative of a probable outcome in the future. If there are only a minimum number of failures, i.e., failures below the set threshold, such a minimum number of failures may not be a reliable data-set for representing a potential failure in the future. The threshold may be selectively adjusted by the system operator, or by the user. The threshold may be low for newer vehicles, since there is generally less data associated with the new vehicles, and high for older vehicles, since there is generally more data associated with the older vehicles.

Referring again to FIG. 3, a threshold of two (2) may be set to filter out all failures that only occur once. Therefore, applying the threshold to the matrix 30, there are no failures that satisfy the threshold in the 0-5,000 mile bracket, only two failures (Component 4) that satisfy the threshold in the 5,000-10,000 mile bracket, three failures (Component 1) that satisfy the threshold in the 10,000-15,000 mile bracket, five failures (Components 2 and 4) that satisfy the threshold in the 15,000-20,000 mile bracket, seven failures (Components 1 and 4) that satisfy the threshold in the 20,000-25,000 mile bracket, and sixteen failures (Components 1, 2, and 4) in the 25,000-30,000 mile bracket.

The matrix 30 may further be beneficial to identify clusters of failures at certain mileage points. For instance, with regard to Component 1 listed in the example matrix, there are three failures between 10,000-15,000 miles and five failures between 20,000-25,000 miles, although there are zero failures in the intermediate mileage bracket (i.e., 15,000-20,000 miles).

After the thresholds have been applied, the overall percentages may be recalculated to determine the percentage of failures within each mileage bracket that meet the threshold.

Figure 4:
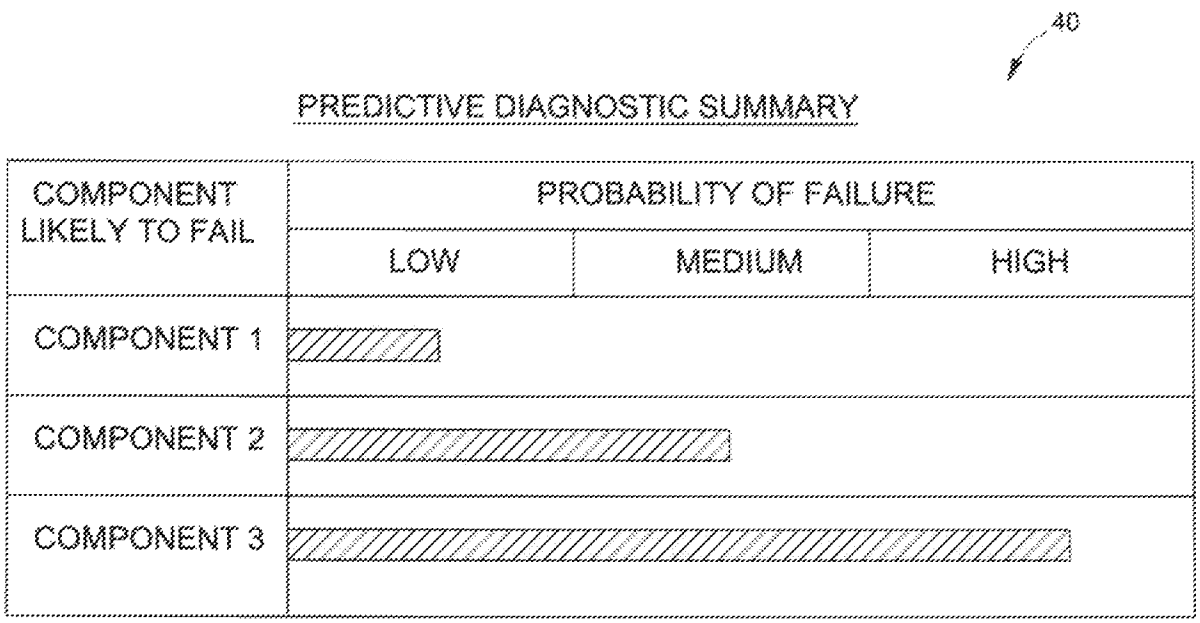
FIG. 4 is one embodiment of a predictive diagnostic report.

The results may be presented to the user in a user friendly summary 40. FIG. 4 shows an exemplary predictive diagnostic summary 40 which displays each component and the likelihood of failure associated with each component. The likelihood of failure is represented as either being LOW, MEDIUM, or HIGH. A LOW likelihood of failure may be associated with 0-30% chance of failure, a MEDIUM likelihood of failure may be associated with 30%-60% chance of failure, while a HIGH likelihood of failure may be associated with a 60%-100% chance of failure. It is also contemplated that the probability of failure may be presented in numerical terms, i.e., the actual likelihood of failure percentage associated with that component. The chances of failure listed above with each likelihood of failure are exemplary in nature only and are not intended to limit the scope of the present invention.

In one embodiment, the predictive diagnostic system 10 may also be capable of, identifying at the server, parts and/or tools useful to repair the defects identified in the diagnostic summary 40. This may also include identifying the likely cost of the parts, tools and services for fixing/replacing the defects/components listed in the predictive diagnostic summary 40. The predictive diagnostic system 16 may also identify at the server, a listing of procedures useful to repair/replace defective components.

In one embodiment the necessary repair parts and/or tools associated with existing and/or predicted defect are identified by the corresponding universal part numbers, or Aftermarket Catalog Enhanced Standard (ACES) part number. This permits parts/service providers and "do it yourself" DIY customers to readily price and order the exact parts/tools necessary to make repairs. Parts/service providers may electronically cross reference ACES numbers to their own parts numbering system to identify the availability/costs of parts and tools without the need for manually identifying any necessary parts, tools or services. DIY customers can locate competitive prices for parts and tools by searching the ACES numbers on the World Wide Web. The results of such a search can also be provided with predictive diagnostic summary 40.

According to other implementation of the present invention, the predictive failure analysis may also be refined based on specific diagnostic history of the vehicle under consideration. In other words, the predictive failure analysis may be able to correlate one part failing in response to another part failing in the past. More specifically, one part or component which wears out may have a cascading effect on wearing out other parts or components, particularly other parts or components within the same vehicle system. Thus, there may be a system level correlation when one part has failed in the past.

The system 10 may also be capable of adjusting the predictive diagnosis for the vehicle under consideration based on operating condition information received from the vehicle, such as live data. The predictive diagnostic system 10 may generate a baseline predictive diagnostic summary when characteristic data is uploaded to the historical database, as described above. From the baseline predictive diagnostic summary, the system 10 may be able to make a prediction as to the general health or remaining effectiveness/lifespan of one or more vehicle components. For instance, the baseline predictive diagnostic summary may be used to predict that a particular component may be useful for another 5,000 miles before the likelihood of failure increases to the point where a failure is likely.

The information extrapolated from the baseline predictive diagnostic summary may be cross-referenced with live data to provide a more accurate prediction as to the remaining lifespan of that component. For instance, if the live data shows a relatively healthy component, the prediction of 5,000 miles before a likely failure may be increased. Conversely, if the live data shows a relatively worn or ineffective component, the prediction of 5,000 miles before a likely failure may be decreased.

Thus, the system 10 may conduct an iterative analysis based on the live data to more accurately predict the likelihood of failure. The iterations include initially generating the baseline diagnostic report from basic characteristic data, i.e., year, make, model, and current mileage. Then the prediction may be refined based on the live data supplied to the system 10. In this regard, the likelihood of failure may be increased, decreased, or remain unchanged based on the live data.

Figure 5A:
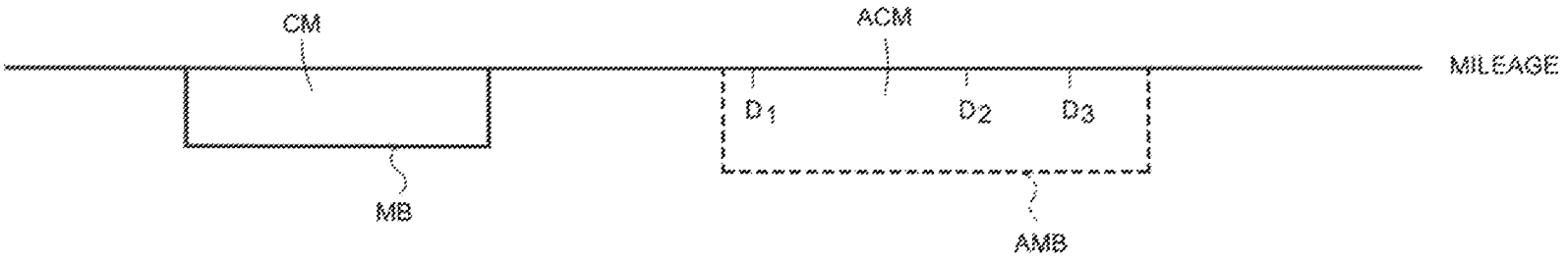
FIG. 5A is a schematic view of adjusting a mileage bracket to identify defects within an adjusted mileage bracket.

Referring now specifically to FIG. 5A, there is shown a schematic view of an adjustment made based on information received from the vehicle. In FIG. 5A, the current mileage "CM" of the vehicle under consideration is identified on a mileage axis. A mileage bracket "MB" is defined along the mileage axis, wherein the mileage bracket MB includes the current mileage CM. The mileage bracket MB may extend from a mileage less than the current mileage CM to a mileage more than the current mileage CM. For instance, the mileage bracket MB may extend for 10,000 miles, and extend from 2,500 miles less than the current mileage CM, to 7,500 more than the current mileage CM. Those skilled in the art will readily appreciate that the upper and lower bounds to the mileage bracket MB may be selectively adjusted as desired by the user.

After vehicle information is analyzed, the current mileage "CM" may be adjusted to define an adjusted current mileage "ACM." For instance, if the vehicle was driven off-road, in harsh conditions, etc., the vehicle may have endured "hard miles." Thus, the current mileage CM for the vehicle may be increased to account for the hard miles. Conversely, if the vehicle was almost exclusively driven in ideal driving conditions, and has been routinely maintained, the current mileage CM of the vehicle may be decreased to account for the optimal conditions. In the example listed in FIG. 5A, the current mileage CM has been increased to define an adjusted current mileage ACM that is greater than the current mileage.

Once the adjusted current mileage ACM has been determined, an adjusted mileage bracket "AMB" is defined based on the adjusted current mileage ACM. The defects which fall within the adjusted mileage bracket AMB are then identified. In FIG. 5A, the defects falling within the adjusted mileage bracket AMB include defects D1, D2, and D3.

Figure 5B:
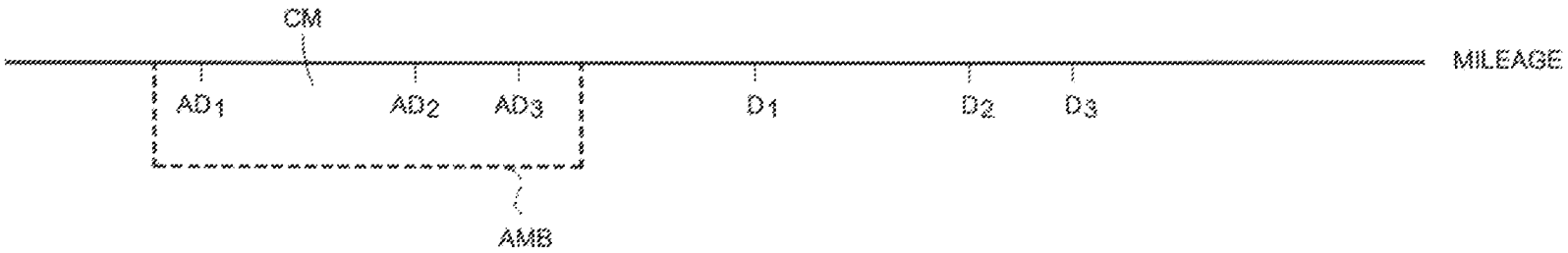
FIG. 5B is a schematic view of adjusting defects and identifying adjusted defects within a mileage bracket.

In the example described above in relation to FIG. 5A, the current mileage is adjusted to define an adjusted current mileage to determine the defects associated with the vehicle. In FIG. 5B, the mileage associated with the defects is adjusted based on the information received from the vehicle. In other words, the information received from the vehicle may make it more likely that defects will occur sooner (i.e., after fewer miles) or later (i.e., after more miles).

After a preliminary assessment, the current mileage CM and defects D1, D2, D3 may be plotted on the mileage axis. A more detailed analysis may reveal that the effective life of the vehicle is less than the standard or more than the standard. Therefore, the mileage associated with the defects may be adjusted along the mileage axis, accordingly. When the effective life of the vehicle is more than the standard, the mileage associated with the defects may be increased, and conversely, if the effective life of the vehicle is less than the standard, the mileage associated with the defects may be decreased.

After this analysis, an adjusted mileage bracket AMB may be created to include the current mileage CM of the vehicle. The adjusted defects AD1, AD2, and AD3 which fall within the adjusted mileage bracket AMB may then be identified.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of predicting and displaying defects likely to occur in a vehicle over a selected mileage bracket, and identifying the parts useful to repair the predicted defects, the selected mileage bracket extending beyond a current vehicle mileage and beyond any additional mileage usage associated with repair of any current or imminent vehicle defects, the method comprising:

a) receiving, on a vehicle data acquisition device, vehicle characteristic data regarding the vehicle under consideration, the vehicle characteristic data comprising vehicle identification information, and current vehicle mileage, the vehicle identification information being independent of live data indicating an operating condition of vehicle devices associated with the vehicle under consideration;

b) communicating the vehicle characteristic data from the vehicle data acquisition device to a remote server;

c) establishing a defect database at the server, the defect database having stored information related to prior defects that have occurred in different vehicles during at least the selected mileage bracket, the stored information including stored vehicle identification data associated with the prior defects, parts associated with repair of the prior defects and a reference mileage at which the prior defects occurred;

d) identifying, at the server, prior defects that occurred in vehicles substantially corresponding to the vehicle under consideration, the stored vehicle identification data associated with the identified prior defects, the parts associated with repair of the identified defects and the reference mileage at which the identified prior defects occurred;

e) comparing, at the server, vehicle the identification information received from the vehicle under test with the stored vehicle identification data associated with the identified prior defects that occurred in the vehicles substantially corresponding to the vehicle under consideration to identify any correspondence therewith, such correspondence indicating that the vehicle under consideration is subject to the identified prior defects;

f) limiting, at the server, the identified prior defects to those prior defects that are associated with the selected mileage bracket;

h) identifying, at the server, parts useful to repair the identified prior defects associated with the selected mileage bracket;

g) communicating, to an internet communicable device, the identified prior defects and a list of parts useful to repair the identified prior defects associated with the selected mileage bracket; and i) displaying on the internet communicable device, the identified prior defects and the list of parts useful to implement repair the of identified prior defects associated with the selected mileage bracket.

2. The method as recited in claim 1, wherein the received vehicle identification data is acquired from an electronic control unit of the vehicle under consideration and includes the year, make, model, engine, and current mileage of the vehicle under consideration.

3. The method as recited in claim 2, wherein the stored vehicle identification data includes the year, make, model and engine associated with each associated prior defect.

4. The method as recited in claim 3, wherein the selected mileage bracket extends from the current vehicle mileage to 30,000 miles greater than the current vehicle mileage.

5. The method as recited in claim 3, further including the step of receiving diagnostic information from the vehicle under consideration, the diagnostic information indicating an operating condition of at least one automotive device associated with the vehicle under consideration.

6. The method as recited in claim 5, further including the step of adjusting the current vehicle mileage based on the diagnostic information indicating the operating condition of the automotive device associated with the vehicle under consideration.

7. The method as recited in claim 6, wherein the step of adjusting the current mileage includes the step of increasing the current vehicle mileage where the diagnostic information indicating the operating condition of the automotive device indicates that the automotive device is not in optimum operating condition.

8. The method as recited in claim 6, wherein the step of adjusting the current mileage includes the step of decreasing the current vehicle mileage where the diagnostic information indicating the operating condition of the automotive device indicates that the automotive device is in optimum operating condition.

9. The method as recited in claim 3, further comprising the steps of receiving information from the vehicle under consideration regarding the climatic region in which the vehicle under consideration has been used, and adjusting the current vehicle mileage based on the information regarding the climate region.

10. The method as recited in claim 9, wherein the step of adjusting the current vehicle mileage based on the information regarding the climatic region comprises the step of increasing the current vehicle mileage where the information regarding the climate region indicates that the vehicle has operated in a region characterized by harsh climate conditions.

11. The method as recited in claim 10, wherein at least one defect is associated with a climatically sensitive vehicle device.

12. The method as recited in claim 11, wherein the climatically sensitive device includes at least one in the group consisting of: a muffler, a body panel, a radiator, a battery, a door lock, and a starter.

13. The method as recited in claim 2, further comprising the step of limiting the identified prior defects to those defects which occurred in a mileage bracket that includes the current mileage of the vehicle under consideration.

14. The method as recited in claim 2, further including the step of adjusting the reference mileage associated with the identified prior defects based on an operating condition associated with the vehicle under consideration.

15. The method as recited in claim 14, wherein the reference mileage associated with the identified prior defects is decreased based on an operating condition associated with the vehicle under consideration.

16. The method as recited in claim 14, wherein the reference mileage associated with the identified prior defects is increased based on an operating condition associated with the vehicle under consideration.

17. The method as recited in claim 1, further including the step of adjusting the current mileage to the nearest 5,000 mile gradient.

18. The method as recited in claim 1, wherein the prior defects in the defect database are derived from actual repair records.

19. The method as recited in claim 1, wherein the prior defects in the defect database are derived from probabilistic determinations of most likely prior defects that occurred in the different vehicles.

20. The method as recited in claim 1, wherein the received vehicle characteristic data includes geographic information associated with the vehicle under consideration.

21. The method as recited in claim 1 further comprising the step of identifying, at the server, a cost of the parts useful to repair the identified prior defects and displaying the cost of the parts useful to repair the identified prior defects on the internet communicable device.

22. The method as recited in claim 1 further comprises the step of identifying, at the server, a cost of the tools useful to repair the identified prior defects and displaying the cost of tools useful to repair the identified prior defects on the internet communicable device.

23. The method as recited in claim 1 further comprises the step of identifying, at the server, tools useful to repair the identified prior defects.

24. The method as recited in claim 23 further comprising the step of identifying, at the server, a universal parts number(s) associated with tools useful to repair the identified prior defects and displaying the universal part number on the internet communicable device.

25. The method as recited in claim 1 further comprising the step of identifying, at the server, a universal parts number(s) associated with parts useful to repair the identified prior defects and displaying the universal part number on the internet communicable device.

26. The method as recited in claim 1 further comprising the step of identifying, at the server, procedures useful to repair the identified prior defects and displaying the procedures useful to repair the identified defects on the internet communicable device.

27. A method of implementing preemptive repair of defects likely to occur in a vehicle under consideration over a selected mileage bracket, the selected bracket range extending beyond a current vehicle mileage and beyond any mileage range associated with repair of any current or imminent vehicle defects:

receiving, on an internet communicable device, vehicle identification data from an electronic control unit of the vehicle under consideration;

communicating the vehicle identification data to a central processing system;

obtaining, using the central processing system, reference data from a historical database, the reference data including prior defects that have occurred in vehicles substantially corresponding to the vehicle under consideration over the selected mileage bracket, the reference defect data defining repairs corresponding with the prior defects and a mileage associated with the prior defects;

predicting, based solely on a comparison of the vehicle identification data and the referenced data over the selected mileage bracket, defects likely to occur in the vehicle under consideration over the selected mileage bracket and identifying corresponding repairs likely to be required by the vehicle under consideration over the selected mileage bracket;

communicating the repairs likely to be required by the vehicle under consideration over the selected mileage bracket to the internet communicable device;

displaying the repairs likely to be required on a display associated with the internet communicable device; and implementing at least one of the repairs likely to be required on the vehicle under consideration, prior to the vehicle under consideration reaching a mileage associated with the corresponding predicted defect.

28. The method as recited in claim 27 wherein the selected mileage bracket extends for at least 10,000 miles beyond the current vehicle mileage.

29. The method as recited in claim 27 wherein the selected mileage bracket extends for at least 20,000 miles beyond the current vehicle mileage.

30. The method as recited in claim 27 wherein the step of predicting repairs likely to be required proceeds independent of any consideration of a current operating condition of the vehicle.

31. A method of predicting and displaying a likely cost repairs expected to be required for a vehicle under consideration over a selected mileage bracket, the selected mileage bracket extending beyond a current vehicle mileage, and beyond any mileage range associated with repair of any current or imminent vehicle defects, the method comprising:

a) using a vehicle data acquisition device, obtaining vehicle characteristic data from an electronic control unit (ECU) of the vehicle under consideration;

b) communicating the vehicle characteristic data from the vehicle data acquisition device to an internet communicable device c) communicating the vehicle characteristic data from the internet communicable device to a remote database;

d) at the remote database, deriving vehicle identification information, vehicle mileage information and vehicle operating condition information from the vehicle characteristic data;

e) identifying, at the remote database, stored defect information associated with vehicles substantially corresponding to the vehicle identification information over the selected mileage bracket, cost of repair information associated with the stored defect information and a mileage associated with the stored defect information;

f) deriving at the remote database, based on a comparison of the vehicle identification information and the stored defect information, a predictive analysis of future defects likely occur in the vehicle under consideration over the selected mileage bracket and the likely cost to repair the future defects, the predictive analysis proceeding independent of any consideration of the vehicle current operating condition information; and g) presenting the predictive analysis of the future defects likely to occur in the vehicle and the likely cost to repair the future defects on a display associated with the internet communicable device.

32. The method as recited in claim 31 further comprising the step of implementing repair of at least one of the defects likely to occur in the future prior to the vehicle under consideration reaching a mileage associated with the at least one of the likely future defects.

33. The method as recited in claim 31 further comprises the steps of deriving at the remote database, based on vehicle current operating information, an identification of any defect(s) currently existing in the vehicle, and the likely cost to repair the currently existing defect(s), and displaying the current defect(s), and the likely cost to repair the current defect(s), on the internet communicable device.

34. The method as recited in claim 33 further comprising the step of implementing repair of at least one of the identified currently existing defects.

35. The method as recited in claim 33 further comprising the step of adjusting the mileage associated with the predictive analysis of defects based on the vehicle operating condition information.

36. The method as recited in claim 33 wherein the vehicle operating condition information comprises vehicle live diagnostic data.

37. The method as recited in claim 31 wherein the selected mileage range further extends beyond the current vehicle mileage and beyond any mileage range associated with repair of any defects identified by the vehicle current operating condition information.

38. The method as recited in claim 31 wherein the selected mileage range further extends at least 10,000 miles beyond any mileage range associated with repair of any defects identified by the vehicle current operating condition information.

* * * * *